US005658453A

United States Patent [19]

Russ et al.

[11] Patent Number: 5,658,453

[45] Date of Patent: Aug. 19, 1997

[54] INTEGRATED AROMATIZATION/TRACE-OLEFIN-REDUCTION SCHEME

[75] Inventors: Michael B. Russ, Villa Park; Aaron P. Kelly, Schaumburg; John Y. G. Park, Naperville, all of Ill.

[73] Assignee: UOP, Des Plaines, Ill.

[21] Appl. No.: 453,604

[22] Filed: May 30, 1995

[51] Int. Cl.[6] ..... C10G 63/02

[52] U.S. Cl. ..... 208/62; 208/144; 208/255; 585/254; 585/258; 585/322

[58] Field of Search ..... 208/62, 144, 255; 585/254, 258, 322

[56] References Cited

U.S. PATENT DOCUMENTS

| | | | |
|---|---|---|---|
| 2,921,016 | 1/1960 | Cuddington et al. | 208/62 |
| 3,124,523 | 3/1964 | Scott, Jr. | 208/62 |
| 3,379,767 | 4/1968 | Kreiter et al. | 585/258 |
| 3,392,107 | 7/1968 | Pfefferle | 208/62 |
| 3,835,037 | 9/1974 | Fairweather et al. | 208/260 |
| 3,865,716 | 2/1975 | Sosnowski | 208/255 |
| 3,869,377 | 3/1975 | Eisenlohr et al. | 208/66 |
| 4,208,271 | 6/1980 | Cosyns et al. | 208/255 |
| 4,885,420 | 12/1989 | Martindale | 585/322 |
| 5,015,794 | 5/1991 | Reichmann | 585/258 |

FOREIGN PATENT DOCUMENTS

| | | | |
|---|---|---|---|
| 45-27338 | 8/1970 | Japan | 208/255 |
| 513014A1 | 10/1989 | U.S.S.R. . | |

*Primary Examiner*—Walter D. Griffin

*Attorney, Agent, or Firm*—Thomas K. McBride; John F. Spears, Jr.; Richard E. Conser

[57] ABSTRACT

A process combination is disclosed to selectively upgrade naphtha in a manner to obtain an aromatics-rich, low-olefin product from the combination. Preferably the naphtha is subjected to aromatization to obtain an aromatics concentrate which is upgraded by hydrogenation of olefins in the aromatics-rich stream. Olefin saturation is effected following separation of the major portion of hydrogen from the aromatics concentrate and before fractionation/stabilization for removal of light ends, with concomitant low saturation of aromatics and with removal of light ends in a fractionator which would be associated with the aromatization in any case.

9 Claims, 1 Drawing Sheet

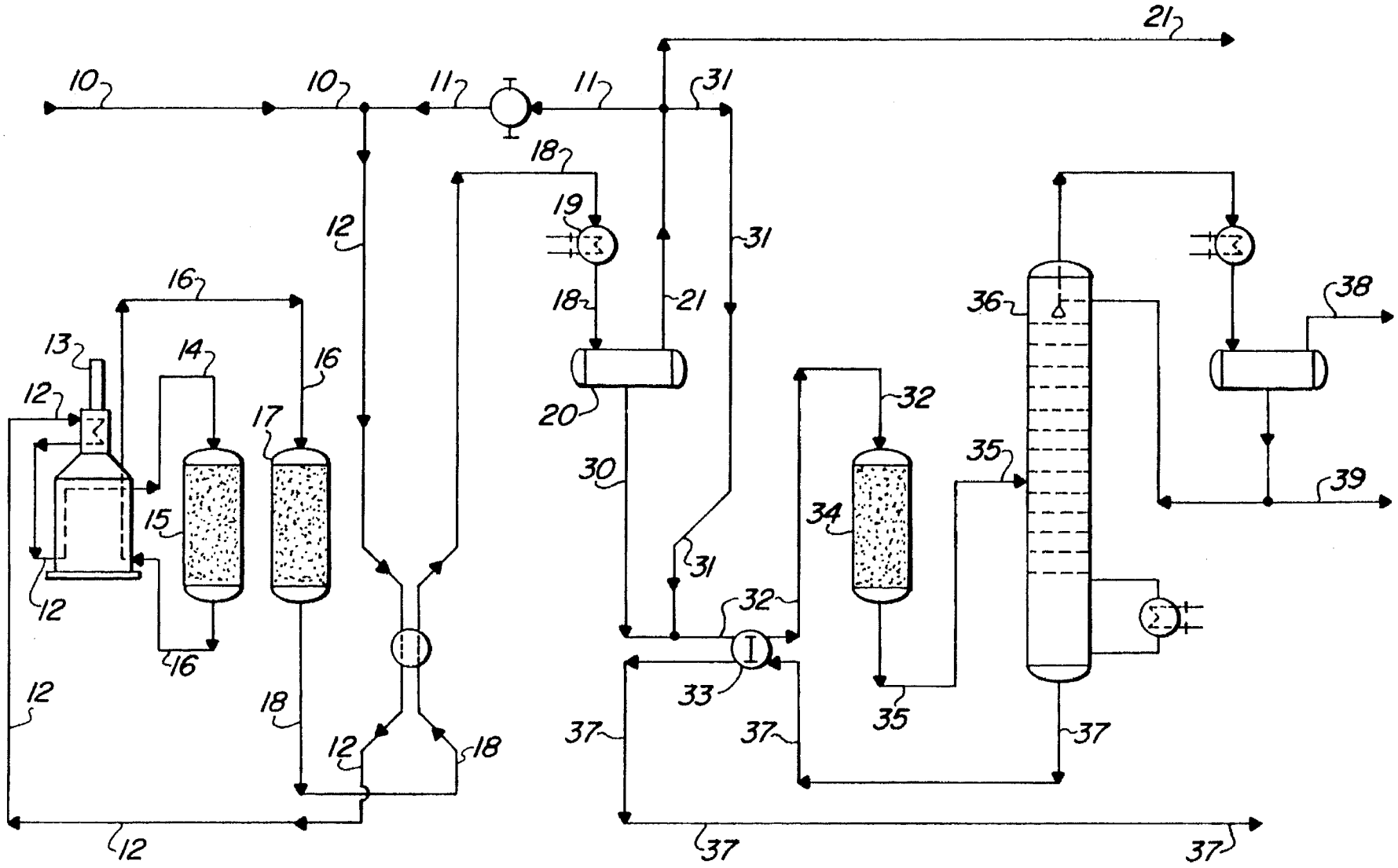
10
11
12
13
14
15
16
17
18
19
20
21
30
31
32
33
34
35
36
37
38
39

INTEGRATED AROMATIZATION/TRACE-OLEFIN-REDUCTION SCHEME

BACKGROUND OF THE INVENTION

1. Field of the Invention

This invention relates to an improved process combination for the conversion of hydrocarbons, and more specifically for an improved reforming/aromatization process.

2. General Background

The widespread removal of lead antiknock additive from gasoline, the rising fuel-quality demands of high-performance internal-combustion engines, and growing demands for chemical aromatics have compelled petroleum refiners to install new and modified processes to increase the severity of processing gasoline-range feedstocks. Refiners have relied on a variety of options to upgrade the gasoline pool, including higher-severity catalytic reforming, higher FCC (fluid catalytic cracking) gasoline octane, isomerization of light naphtha and the use of oxygenated compounds.

Catalytic reforming, or aromatization as the modern selective version often is termed, is a major focus since this process generally supplies 30–40% or more of the gasoline pool as well as most of the chemical benzene, toluene and xylenes. Increased aromatization severity often is accompanied by a reduction in pressure in order to obtain high yields of aromatics and gasoline product from the process. Both higher severity and lower pressure promote the formation of olefins in aromatization, and the 1–2+% of olefins in modern reformates contribute to undesirable gum and high endpoint in gasoline product as well as high clay consumption in aromatics-recovery operations.

Aromatization product often is clay treated to polymerize the small concentrations of olefin present [see, e.g., U.S. Pat. No. 3,835,037 (Fairweather et al.)]. This procedure forms heavy polymer, undesirable in gasoline component since it forms deposits in engines; further, the clay is costly and disposal of spent clay may be difficult and expensive. A problem facing workers in the art, therefore, is to discover a method of olefin removal which does not suffer the above drawbacks.

Considering selective hydrogenation of olefins, U.S. Pat. No. 3,869,377 (Eisenlohr et al.) teaches elimination of aliphatic unsaturates from a reformate by cooling a reaction mixture from hydroforming which contains hydrogen and aromatics and passing this mixture in gaseous state through a reactor containing a catalyst comprising oxides of Group 6 and/or 8 metals [preferably cobalt and molybdenum]. Russian disclosure SU1513014-A (Maryshev et al.) teaches hydrogenation of reforming products at elevated temperature in the presence of aluminum-platinum catalysts. Hydrogenation of olefins by adding a reactor within the hydrogen circuit of an associated unit suffers the disadvantage of adding pressure drop to the circuit, and also does not provide control of the ratio of hydrogen to olefin in the saturation zone, and does not reduce the concentration of hydrogen in separator liquid to a subsequent fractionator as in the present invention.

Selective hydrogenation of small quantities of alkenes in xylene-isomerization product, using a hydrogenation metal supported on a crystalline borosilicate molecular sieve, is disclosed in U.S. Pat. No. 5,015,794 (Reichmann). U.S. Pat. No. 4,885,420 (Martindale) teaches hydrogenation of relatively large concentrations of olefins in a light ($C_2$–$C_5$) hydrocarbon stream, wherein the concern in the present application relating to aromatics saturation is not an issue.

SUMMARY OF THE INVENTION

It is an object of the present invention to provide an improved process combination to upgrade hydrocarbons by hydroprocessing. A specific object is to reduce the olefin content of catalytic reformate with minimal saturation of contained aromatics. A secondary object is to integrate olefin reduction into a reforming unit to keep the cost of new equipment to a minimum.

This invention is based on the discovery that a process combination in which olefin saturation is integrated into an aromatization process after separation of hydrogen and before stabilization of the product offers improved product quality and effective equipment utilization.

A broad embodiment of the present invention is directed to a process combination comprising reforming or aromatization followed by olefin saturation. Preferably the combination comprises catalytic aromatization to obtain an olefin-containing aromatized product, separation of hydrogen from the aromatization effluent, saturation of olefins in the liquid from separation, and fractionation of the saturated aromatics-rich product. Heat integration around the fractionation optimally avoids the need to heat the feed to olefin saturation.

The olefin-saturation reaction preferably is effected in mixed vapor-liquid phase, preferably with hydrogen-rich gas added to the olefin-saturation reaction. The saturation catalyst comprises a refractory inorganic oxide containing preferably a platinum-group metal and optionally a metal modifier.

These as well as other objects and embodiments will become apparent from the detailed description of the invention.

BRIEF DESCRIPTION OF THE DRAWING

The Figure represents a simplified block flow diagram showing the arrangement of major equipment in a preferred embodiment of the present invention.

DESCRIPTION OF THE PREFERRED EMBODIMENTS

The present invention is broadly directed to a process combination in which a selective olefin-saturation step is integrated with a hydroprocessing step. "Hydroprocessing" in the present sense could encompass refinery or petrochemical processes which effect conversion of a feedstock in the presence of free hydrogen. Types of hydroprocessing which could benefit from the inclusion of olefin saturation comprise, without limiting the invention, isomerization, disproportionation, transalkylation, dealkylation, hydrocracking, reforming and dehydrocyclization.

Reforming in the form of aromatization and/or dehydrocyclization comprises the preferred hydroprocessing step of the present invention. Naphtha is processed in an aromatization zone to obtain a aromatized product of increased octane number and aromatics content, followed by hydrogenation of olefins in a saturation zone.

The preferred aromatization embodiment of the invention is illustrated in simplified form in the Figure. This drawing shows the concept of the invention while omitting details known to the skilled routineer, such as appurtenant vessels, heat exchangers, piping, pumps, compressors, instruments and other standard equipment.

A naphtha feedstock is introduced into the process combination via line 10, combining with recycled hydrogen-rich gas in line 11 and exchanging heat as combined feed in line 12 with reactor effluent in line 18. The combined feed then is heated in heater 13 and passes via line 14 to the first aromatization reactor 15. Substantial dehydrogenation of naphthenes takes place in this reactor, along with generally lesser amounts of paraffin dehydrocyclization, isomerization and cracking, and the endothermic dehydrogenation reactions result in a substantial temperature drop. Effluent from the first reactor, therefore, passes through line 16 to the heater which raises the temperature of the reactants to levels which are suitable for further aromatization in reactor 17. The sequence of heating and further reaction usually is repeated at least once, and often twice or three times, depending on the feedstock, reaction conditions and resulting balance of endothermic and other reactions in the aromatization step.

An aromatization effluent stream from the last aromatization reactor passes via line 18, exchanges heat with the feed as discussed above, is cooled in exchanger 19, and passes to separator 20. Most of the hydrogen present in the effluent is separated, along with substantial quantities of light hydrocarbons, as a hydrogen-rich gas from the separator with most of this gas being recycled to the aromatization step via line 11. A lesser portion, corresponding nearly to the amount generated by reactions in the aromatization zone, is taken as net hydrogen-rich gas via line 21. The aromatics-rich intermediate liquid stream from the separator contains a small proportion of olefins in a concentration which would significantly decrease clay life in a subsequent treater or otherwise renders it unacceptable for further processing.

Separator liquid in line 30, comprising olefin-containing aromatics-rich intermediate stream and a small quantity of dissolved hydrogen and hydrocarbon gases, preferably is combined with a portion of the net hydrogen-rich gas in line 31 and passes via line 32 to exchanger 33. The hydrogen is added in a ratio to olefins to restrict concomitant saturation of aromatics; such addition may be more or less than the consumption in the saturation zone, depending on such factors as olefin concentration and desired saturation. In this embodiment of the saturation zone, the separator liquid and hydrogen are brought to the required temperature for olefin saturation by heat exchange with a stabilized aromatics-rich product taken from fractionator 36 via line 37. The separator liquid then contacts saturation catalyst in reactor 34, reducing the olefin content of the of the aromatics-rich intermediate stream to obtain a saturated effluent stream.

Effluent from the reactor in the saturation zone passes via line 35 to fractionator 36, in which light hydrocarbons and hydrogen are removed overhead to produce a stabilized aromatics-rich product from the bottom of the fractionator in line 37. Usually propane and lighter or butanes and lighter components are taken overhead from the fractionator, yielding off-gas via line 38 and net overhead liquid (if any) via line 39.

The temperature of the stabilized reformate in line 37 generally is sufficient to provide the temperature required for the separator liquid in line 32 to be raised to the required saturation temperature via heat exchange in the absence of an external heat supply. Optionally, other means known in the art for bringing the separator liquid to the appropriate temperature for olefin saturation may be used instead of or in conjunction with the heat exchange described above.

Other hydroprocessing steps which could benefit from the inclusion of olefin saturation comprise, without limiting the invention, isomerization, disproportionation, transalkylation, dealkylation, hydrocracking, reforming and dehydrocyclization. Usually the process combination is integrated into a petroleum refinery comprising crude-oil distillation, cracking, product recovery and other processes known in the art to produce finished gasoline and other petroleum or petrochemical products.

Isomerization of light hydrocarbons such as $C_4$–$C_7$ paraffins use catalyst compositions which usually contain a platinum-group metal and a refractory inorganic oxide; optional components include a Friedel-Crafts metal halide or a zeolitic molecular sieve. The light hydrocarbon feedstock contacts the catalyst at pressures of between atmospheric and 70 atmospheres, temperatures of about 50° to 300° C., LHSV from 0.2 to 5 $hr^{-1}$, and hydrogen-to-hydrocarbon molar ratios of from about 0.1 to 5. Usually isomerization yields a product having an increased concentration of branched hydrocarbons.

Heavier paraffins, waxy distillates and raffinates usually having a carbon number range of $C_7$–$C_{20}$ are isomerized to increase the branching of the hydrocarbons using catalyst compositions within the above definition of isomerization catalysts. Operating conditions include pressures of between about 20 and 150 atmospheres, higher temperatures than for light paraffins of about 200° to 450° C., LHSV from 0.2 to 10 $hr^{-1}$, and hydrogen-to-hydrocarbon molar ratios of from about 0.5 to 10.

Isomerization of isomerizable alkylaromatic hydrocarbons of the general formula $C_6H_{(6-n)}R_n$ (wherein R represents one or more aliphatic side chains, n represents the number of side chains and a $C_8$-aromatic mixture containing ethylbenzene and xylenes is preferred) is effected using a catalyst comprising one or more platinum-group metals, a refractory inorganic oxide, and preferably one or more zeolitic or non-zeolitic molecular sieves. The conditions comprise a temperature ranging from about 0° to 600° C. or more, and preferably is in the range of from about 300° to 500° C. The pressure generally is from about 1 to 100 atmospheres absolute, preferably less than about 50 atmospheres and the liquid hourly space velocity from about 0.1 to 30 $hr^{-1}$. The hydrogen/hydrocarbon mole ratio of about 0.5:1 to about 25:1 or more.

Transalkylation and disproportionation are effected with catalyst compositions comprising one or more Group VIII (IUPAC 8–10) metals and a refractory inorganic oxide; optionally, the catalyst also contains a molecular sieve and one or more Group VIA (IUPAC 6) metals. Suitable feedstocks include single-ring aromatics, naphthalenes and light olefins, and the reaction yields more valuable products of the same hydrocarbon specie. Isomerization and transalkylation also may occur at the operating conditions of between 10 and 70 atmospheres, temperatures of about 200° to 500° C., and LHSV from 0.1 to 10 $hr^{-1}$. Hydrogen is optionally present at a molar ratio to hydrocarbon of from about 0.1 to 10.

In catalytic dealkylation wherein it is desired to cleave paraffinic side chains from aromatic nuclei without substantially hydrogenating the ring structure, relatively high temperatures in the range of about 450° to 600° C. are employed at moderate hydrogen pressures of about 20 to 70 bar and a liquid hourly space velocity of from about 0.1 to 20 $hr^{-1}$. Preferred catalysts comprise one or more Group VIII (IUPAC 8–10) metals and a refractory inorganic oxide, and may contain a zeolitic molecular sieve. Particularly desirable dealkylation reactions contemplated herein include the conversion of methylnaphthalene to naphthalene and toluene and/or xylenes to benzene.

Catalyst compositions used in hydrocracking processes preferably contain a hydrogenation promoter such as one or more of Group VIII (IUPAC 8–10) and Group VIB (IUPAC 6) metals, optionally a molecular sieve, and an inorganic-oxide matrix. A variety of feedstocks including atmospheric and vacuum distillates, cycle stocks and residues are cracked to yield lighter products at pressures of between 30 and 200 atmospheres, temperatures of about 200° to 450° C., LHSV from 0.1 to 10 $hr^{-1}$, and hydrogen-to-hydrocarbon molar ratios of from about 2 to 80.

Aromatization, as the reforming version of the preferred hydroprocessing step, may be carried out in two or more fixed-bed reactors in sequence or in moving-bed reactors with continuous catalyst regeneration; the process combination of the invention is useful in both embodiments. The reactants may contact the catalyst in upward, downward, or radial-flow fashion, with radial flow being preferred. Aromatization operating conditions include a pressure of from about atmospheric to 60 atmospheres (absolute), with the preferred range being from atmospheric to 20 atmospheres and a pressure of below 10 atmospheres being especially preferred. Hydrogen is supplied to the aromatization zone in an amount sufficient to correspond to a ratio of from about 0.1 to 10 moles of hydrogen per mole of hydrocarbon feedstock. The operating temperature generally is in the range of 260° to 560° C. The volume of the contained aromatization catalyst corresponds to a liquid hourly space velocity of from about 0.5 to 40 $hr^{-1}$.

The naphtha feedstock to the preferred aromatization embodiment of the process combination comprises paraffins, naphthenes, and aromatics, and may comprise a small proportion of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range generally is that of a full-range naphtha, having an initial boiling point typically from 0° to 100° C. and a 95%-distilled point of from about 160° to 230° C.; more usually, the initial boiling range is from about 40° to 80° C. and the 95%-distilled point from about 175° to 200° C. Generally the naphtha feedstock contains less than about 30 mass % $C_6$ and lighter hydrocarbons, and usually less than about 20 mass % $C_6$–, since the objectives of gasoline reformulation and benzene reduction are more effectively accomplished by processing higher-boiling hydrocarbons; $C_6$ and lighter hydrocarbons generally are upgraded more effectively by isomerization.

The naphtha feedstock generally contains small amounts of sulfur and nitrogen compounds each amounting to less than 10 parts per million (ppm) on an elemental basis. Preferably the naphtha feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from hydrocarbons by fractionation. This conversion preferably will employ a catalyst known to the art comprising an inorganic oxide support and metals selected from Groups VIB(IUPAC 6) and VIII(9–10) of the Periodic Table. [See Cotton and Wilkinson, *Advanced Inorganic Chemistry*, John Wiley & Sons (Fifth Edition, 1988)]. Optimally, the pretreating step will provide the preferred aromatization step with a hydrocarbon feedstock having low sulfur levels disclosed in the prior art as desirable, e.g., 1 ppm to 0.1 ppm (100 ppb). It is within the ambit of the present invention that this optional pretreating step be included in the present process combination.

The aromatization catalyst conveniently is a dual-function composite containing a metallic hydrogenation-dehydrogenation component on a refractory support which provides acid sites for cracking, isomerization, and cyclization. The hydrogenation-dehydrogenation component comprises a supported platinum-group metal component, with a platinum component being preferred. The platinum may exist within the catalyst as a compound, in chemical combination with one or more other ingredients of the catalytic composite, or as an elemental metal; best results are obtained when substantially all of the platinum exists in the catalytic composite in a reduced state. The catalyst may contain other metal components known to modify the effect of the preferred platinum component, including Group IVA (IUPAC 14) metals, other Group VIII (IUPAC 8–10) metals, rhenium, indium, gallium, zinc, uranium, dysprosium, thallium and mixtures thereof with a tin component being preferred.

The refractory support of the aromatization catalyst should be a porous, adsorptive, high-surface-area material which is uniform in composition. Preferably the support comprises refractory inorganic oxides such as alumina, silica, titania, magnesia, zirconia, chromia, thoria, boria or mixtures thereof, especially alumina with gamma- or eta-alumina being particularly preferred and best results being obtained with "Ziegler alumina" as described in the references. Optional ingredients are crystalline zeolitic aluminosilicates, either naturally occurring or synthetically prepared such as FAU, MEL, MFI, MOR, MTW (IUPAC Commission on Zeolite Nomenclature), and non-zeolitic molecular sieves such as the aluminophosphates of U.S. Pat. No. 4,310,440 or the silico-aluminophosphates of U.S. Pat. No. 4,440,871 (incorporated by reference). Further details of the preparation and activation of embodiments of the above aromatization catalyst are disclosed in U.S. Pat. No. 4,677,094 (Moser et al.), which is incorporated into this specification by reference thereto.

In an advantageous alternative embodiment, the aromatization catalyst comprises a large-pore molecular sieve. The term "large-pore molecular sieve" is defined as a molecular sieve having an effective pore diameter of about 7 angstroms or larger. Examples of large-pore molecular sieves which might be incorporated into the present catalyst include LTL, FAU, AFI, MAZ, and zeolite-beta, with a nonacidic L-zeolite (LTL) being especially preferred. An alkali-metal component, preferably comprising potassium, and a platinum-group metal component, preferably comprising platinum, are essential constituents of the alternative aromatization catalyst. The alkali metal optimally will occupy essentially all of the cationic exchangeable sites of the nonacidic L-zeolite. Further details of the preparation and activation of embodiments of the alternative aromatization catalyst are disclosed, e.g., in U.S. Pat. No. 4,619,906 (Lambert et al) and U.S. Pat. No. 4,822,762 (Ellig et al.), which are incorporated into this specification by reference thereto.

The aromatization effluent stream is separated to obtain a hydrogen-rich gas and an aromatics-rich intermediate stream. The major portion of the hydrogen-rich gas is recycled and supplied to the aromatization zone, while a lesser portion, corresponding nearly to the amount generated by reactions in the aromatization zone, is taken as net hydrogen-rich gas. The aromatics-rich intermediate stream, containing a small proportion of olefins, comprises feed to the saturation zone.

The aromatics-rich intermediate stream, taken as a liquid from the separator of the aromatization zone, contains dissolved hydrogen. This hydrogen usually amounts to between about 0.05 and 0.5 mole-%, more usually between about 0.1 and 0.3 mole-%, of the aromatics-rich intermediate stream and generally is supplemented by hydrogen-rich gas from the aromatization zone as described hereinbelow.

The small proportion of olefins in the aromatics-rich intermediate stream to the saturation zone is in an amount depending on aromatization feedstock, severity and operating conditions and generally is between about 0.2 and 3 mass %, and more usually from about 0.3 to 2.5 mass %. The saturation zone selectively hydrogenates generally more than about 50%, more usually at least about 70%, and often 80% or more of olefins in the aromatics-rich product at relatively mild conditions to avoid saturation of aromatics. The aromatics-rich intermediate stream generally contains between about 40 and 90 mass-% aromatics, and more usually between about 50 and 80 mass-%, depending upon the nature of the feedstock and the severity of the aromatization conditions. Aromatics saturation, which principally yields naphthenes, is controlled according to the present invention, to less than about 1 mass % of the aromatics in the feed; preferably essentially no net aromatic saturation occurs.

The saturation zone contains a bed of catalyst which suitably comprises one or more of nickel and the platinum-group metals. Contacting within the saturation zone may be effected using the catalyst in a fixed-bed system, a moving-bed system, a fluidized-bed system, or in a batch-type operation. In view of the danger of attrition loss of the valuable catalyst and of operational advantages, it is preferred to use a fixed-bed system. The catalyst generally is contained in a single reactor, as the low level of olefins in the feed generally does not warrant multiple reactors with intermediate temperature control. The reactants may be contacted with the bed of catalyst particles in either upward, downward, or radial flow fashion. The reactants may be in the liquid phase, a mixed liquid-vapor phase, or a vapor phase when contacted with the catalyst particles; mixed liquid-vapor contacting is preferred. As described hereinabove with respect to the Figure, the combined feed is preheated by suitable heating means which preferably comprises heat exchange with a fractionator bottoms stream to the desired reaction temperature and then passed into a reactor containing the bed of catalyst.

Operating conditions in the saturation zone include pressures from about 100 kPa to 10 MPa absolute, preferably between about 300 kPa and 4 MPa. Temperature for selective olefin hydrogenation is between about 30° and 300° C. and more usually from about 60° and 250° C., and this generally can be effected via heat exchange with a bottoms stream from an associated fractionator as discussed herein. The liquid hourly space velocity (LHSV) range from about 1 to 100 $hr^{-1}$ and preferably up to about 40 $hr^{-1}$.

Hydrogen to hydrocarbon ratios are established to effect olefin saturation with little or minimal aromatics saturation, considering the content of olefins in the olefin-containing aromatics-rich intermediate. The hydrogen usually usually is present in the range of about 0.5 to 5 moles per mole of olefins present; more usually, the molar ratio of hydrogen to olefins is between about 1 and 3, and optimally no more than about 2. Considering the range of feedstock olefin contents, the molar ratio of hydrogen to aromatics-rich intermediate generally is in the range of about 0.005 to 0.08, and more usually from about 0.01 to 0.06.

The saturation catalyst comprises an inorganic-oxide binder and a Group VIII (IUPAC 8–10) metal component. The refractory inorganic-oxide support optimally is a porous, adsorptive, high-surface-area support having a surface area of about 25 to about 500 $m^2/g$. The porous carrier material should also be uniform in composition and relatively refractory to the conditions utilized in the process. By the term "uniform in composition," it is meant that the support be unlayered, has no concentration gradients of the species inherent to its composition, and is completely homogeneous in composition. Thus, if the support is a mixture of two or more refractory materials, the relative amounts of these materials will be constant and uniform throughout the entire support. It is intended to include within the scope of the present invention refractory inorganic oxides such as alumina, titania, zirconia, chromia, zinc oxide, magnesia, thoria, boria, silica-alumina, silica-magnesia, chromia-alumina, alumina-boria, silica-zirconia and other mixtures thereof.

The preferred refractory inorganic oxide for use in the present invention is alumina. Suitable alumina materials are the crystalline aluminas known as the gamma-, eta-, and theta-alumina, with gamma- or eta-alumina giving best results. Zirconia, alone or in combination with alumina, comprises an alternative inorganic-oxide component of the catalyst. The preferred refractory inorganic oxide will have an apparent bulk density of about 0.3 to about 1.01 g/cc and surface area characteristics such that the average pore diameter is about 20 to 300 angstroms, the pore volume is about 0.05 to about 1 cc/g, and the surface area is about 50 to about 500 $m^2/g$.

A particularly preferred alumina is that which has been characterized in U.S. Pat. No. 3,852,190 and 4,012,313 as a byproduct from a Ziegler higher alcohol synthesis reaction as described in Ziegler's U.S. Pat. No. 2,892,858. For purposes of simplification, such an alumina will be hereinafter referred to as a "Ziegler alumina." Ziegler alumina is presently available from the Vista Chemical Company under the trademark "Catapal" or from Condea Chemie GMBH under the trademark "Pural." This material is an extremely high purity pseudo-boehmite powder which, after calcination at a high temperature, has been shown to yield a high-purity gamma-alumina.

The alumina powder may be formed into a suitable catalyst material according to any of the techniques known to those skilled in the catalyst-carrier-forming art. Spherical carrier particles may be formed, for example, from this Ziegler alumina by: (1) converting the alumina powder into an alumina sol by reaction with a suitable peptizing acid and water and thereafter dropping a mixture of the resulting sol and a gelling agent into an oil bath to form spherical particles of an alumina gel which are easily converted to a gamma-alumina carrier material by known methods; (2) forming an extrudate from the powder by established methods and thereafter rolling the extrudate particles on a spinning disk until spherical particles are formed which can then be dried and calcined to form the desired particles of spherical carrier material; and (3) wetting the powder with a suitable peptizing agent and thereafter rolling the particles of the powder into spherical masses of the desired size. This alumina powder can also be formed in any other desired shape or type of carrier material known to those skilled in the art such as rods, pills, pellets, tablets, granules, extrudates, and like forms by methods well known to the practitioners of the catalyst material forming art.

The preferred form of carrier material for the saturation catalyst is a cylindrical extrudate. The extrudate particle is optimally prepared by mixing the alumina powder with water and suitable peptizing agents such as nitric acid, acetic acid, aluminum nitrate, and the like material until an extrudable dough is formed. The amount of water added to form the dough is typically sufficient to give a Loss on Ignition (LOI) at 500° C. of about 45 to 65 mass %, with a value of 55 mass % being especially preferred. The resulting dough is then extruded through a suitably sized die to form extrudate particles.

The extrudate particles are dried at a temperature of about 150° to about 200° C., and then calcined at a temperature of about 450° to 800° C. for a period of 0.5 to 10 hours to effect the preferred form of the refractory inorganic oxide. It is preferred that the refractory inorganic oxide comprise substantially pure gamma alumina having an apparent bulk density of about 0.6 to about 1 g/cc and a surface area of about 150 to 280 $m^2/g$ (preferably 185 to 235 $m^2/g$, at a pore volume of 0.3 to 0.8 cc/g).

An essential component of the preferred saturation catalyst is a platinum-group metal or nickel. Of the preferred platinum group, i.e., platinum, palladium, rhodium, ruthenium, osmium and iridium, palladium is a favored component and platinum is especially preferred. Mixtures of platinum-group metals also are within the scope of this invention. This component may exist within the final catalytic composite as a compound such as an oxide, sulfide, halide, or oxyhalide, in chemical combination with one or more of the other ingredients of the composite, or as an elemental metal. Best results are obtained when substantially all of this metal component is present in the elemental state. This component may be present in the final catalyst composite in any amount which is catalytically effective, and generally will comprise about 0.01 to 2 mass % of the final catalyst calculated on an elemental basis. Excellent results are obtained when the catalyst contains from about 0.05 to 1 mass % of platinum.

The platinum-group metal component may be incorporate into the saturation catalyst in any suitable manner such as coprecipitation or cogellation with the carrier material, ion exchange or impregnation. Impregnation using water-soluble compounds of the metal is preferred. Typical platinum-group compounds which may be employed are chloroplatinic acid, ammonium chloroplatinate, bromoplatinic acid, platinum dichloride, platinum tetrachloride hydrate, tetraamine platinum chloride, tetraamine platinum nitrate, platinum dichlorocarbonyl dichloride, dinitrodiaminoplatinum, palladium chloride, palladium chloride dihydrate, palladium nitrate, etc. Chloroplatinic acid is preferred as a source of the especially preferred platinum component.

It is within the scope of the present invention that the catalyst may contain other metal components known to modify the effect of the platinum-group metal component. Such metal modifiers may include rhenium, tin, germanium, lead, cobalt, nickel, indium, gallium, zinc, uranium, dysprosium, thallium, and mixtures thereof, with tin being a preferred component. Catalytically effective amounts of such metal modifiers may be incorporated into the catalyst by any means known in the art.

The composite is dried at a temperature of about 100° to 300° C., followed by calcination or oxidation at a temperature of from about 375° to 600° C. in an air or oxygen atmosphere for a period of about 0.5 to 10 hours in order to convert the metallic components substantially to the oxide form.

The resultant oxidized catalytic composite is subjected to a substantially water-free and hydrocarbon-free reduction step. This step is designed to selectively reduce the platinum-group component to the corresponding metal and to insure a finely divided dispersion of the metal component throughout the carrier material. Substantially pure and dry hydrogen (i.e., less than 20 vol. ppm $H_2O$) preferably is used as the reducing agent in this step. The reducing agent is contacted with the oxidized composite at conditions including a temperature of about 425° C. to about 650° C. and a period of time of about 0.5 to 2 hours to reduce substantially all of the platinum-group metal component to its elemental metallic state.

The saturation zone produces a saturated effluent which usually is processed in a separation section, suitably comprising one or more fractional distillation columns having associated appurtenances known in the art. Such fractionation separates the a trace residual hydrogen-containing gas and comprising light gases which remain from the aromatization zone and were introduced in the saturation zone as well as unconverted hydrogen-rich gas, producing a stabilized-aromatics-rich product as a fractionator bottoms stream. The temperature of the fractionator bottoms usefully represents sufficient energy to raise the aromatics-rich intermediate to saturation temperature without further heating, using control methods known in the art such as bypass flow control.

Preferably part or all of each of the saturated aromatics-rich product either is processed in an aromatics complex to obtain high-purity aromatics such as benzene, toluene, or $C_8$ aromatics or is blended with other gasoline constituents available in a refinery to obtain finished gasoline. Such other constituents include but are not limited to one or more of butanes, butenes, pentanes, naphtha, catalytic reformate, isomerate, alkylate, polymer, aromatic extract, heavy olefins; gasoline from catalytic cracking, hydrocracking, thermal cracking, thermal reforming, steam pyrolysis and coking; oxygenates from sources outside the combination such as methanol, ethanol, propanol, isopropanol, TBA, SBA, MTBE, ETBE, MTAE and higher alcohols and ethers; and small amounts of additives to promote gasoline stability and uniformity, avoid corrosion and weather problems, maintain a clean engine and improve driveability. If the aromatics-rich product is further processed for recovery of petrochemical aromatics instead of being blended directly into gasoline, a low olefin content is advantageous for final product purity or to reduce or eliminate consumption of clay in further treating.

EXAMPLES

The following examples serve to illustrate certain specific embodiments of the present invention. These examples should not, however, be construed as limiting the scope of the invention as set forth in the claims. There are many possible other variations, as those of ordinary skill in the art will recognize, which are within the spirit of the invention.

Example 1

The olefin-containing reformate, or aromatics-rich intermediate, upon which the following examples was based had the following approximate characteristics:

| | |
|---|---|
| Specific gravity | 0.8287 |
| Distillation, ASTM D-86, °C. | |
| IBP | 59 |
| 10% | 105 |

-continued

| | |
|---|---|
| 50% | 142 |
| 90% | 184 |
| 95% | 218 |
| EP | 236 |
| Mass % paraffins | 20.6 |
| olefins | 1.15 |
| naphthenes | 1.35 |
| aromatics | 76.9 |

Favorable performance in the following examples is evaluated on the basis of high olefin saturation and low hydrogenation of valuable $C_6$–$C_8$ aromatics. The $C_6$–$C_8$ aromatics content of the olefin-containing reformate was about 41.0 mass %.

Example 2

Two catalysts were tested for effectiveness in selective olefin saturation as indicated below. Key characteristics of these catalysts are:

Catalyst A: Spherical alumina base containing 0.29% platinum and 0.30% tin

Catalyst B: Spherical alumina base containing 0.78% platinum

Example 3

Olefin saturation in the reformate, or aromatics-rich intermediate, was tested based on a prior-art process combination. The test simulated a saturation zone containing Catalyst A in an aromatization hydrogen circuit after the last aromatization reactor, thereby providing a substantial excess of hydrogen to the saturation zone. Operating conditions were as follows (absolute pressure):

| | |
|---|---|
| Temperature, °C. | 65–205 |
| Pressure, kPa | 380 |
| LHSV, $hr^{-1}$ | 12.6 |
| Hydrogen/hydrocarbon, mol | 3.75 |

The hydrogen/hydrocarbon ratio corresponds to a ratio of more than 250 with respect to olefins in the reformate.

Results were as follows ("aromatics"=$C_6$–$C_8$ aromatics):

| Temperature, °C. | 65 | 121 | 205 |
|---|---|---|---|
| Olefins, mass % | 1.01 | 0.66 | 0.68 |
| % removal | 12 | 43 | 41 |
| Aromatics, mass % | 41.17 | 41.28 | 41.25 |

Example 4

Reformate olefin saturation was tested using Catalyst A in a process combination not according to the present invention, in which no hydrogen was present in the olefin-saturation step. Operating conditions were as follows (absolute pressure):

| | |
|---|---|
| Temperature, °C. | 260 |
| Pressure, kPa | 1135 |
| LHSV, $hr^{-1}$ | 12.6 |

Results were as follows ("aromatics"=$C_6$–$C_8$ aromatics):

| | |
|---|---|
| Olefins, mass % | 1.10 |
| % removal | 4 |
| Aromatics, mass % | 41.65 |

Olefin saturation in the absence of hydrogen thus was ineffective.

Example 5

Reformate olefin saturation was tested using Catalyst A in a process combination according to the present invention. Hydrogen supply to the saturation zone was controlled to a level slightly in excess of the stoichiometric ratio to saturate all of the olefins in the olefin-containing reformate. Operating conditions were as follows (absolute pressure):

| | |
|---|---|
| Temperature, °C. | 65–315 |
| Pressure, kPa | 1135 |
| LHSV, $hr^{-1}$ | 12.6 |
| Hydrogen/olefin, mol | 1.16 |
| Hydrogen/reformate, mol | 0.16 |

Results were as follows ("aromatics" $C_6$–$C_8$ aromatics):

| Temperature, °C. | 121 | 205 | 260 | 315 |
|---|---|---|---|---|
| Olefins, mass % | 0.44 | 0.23 | 0.67 | 1.02 |
| % removal | 62 | 80 | 42 | 11 |
| Aromatics, mass % | 40.95 | 40.92 | 40.89 | 40.92 |

Selective olefin saturation at moderate temperatures was clearly superior to the operation of process combinations of the prior art.

Example 6

Selective olefin saturation was tested using alternative Catalyst B in a process combination according to the present invention. Hydrogen supply to the saturation zone was controlled to a level just over three times the stoichiometric ratio to saturate the olefins in the aromatics-rich intermediate. Operating conditions were as follows (absolute pressure):

| | |
|---|---|
| Temperature, °C. | 177 |
| Pressure, kPa | 1135 |
| LHSV, $hr^{-1}$ | 12.6 |
| Hydrogen/olefin, mol | 3.38 |
| Hydrogen/reformate, mol | 0.46 |

Results were as follows ("aromatics"=$C_6$–$C_8$ aromatics):

| | |
|---|---|
| Olefins, mass % | 0.20 |
| % removal | 83 |
| Aromatics, mass % | 41.12 |

Over 80% olefin saturation was effected with no hydrogenation of $C_6$–$C_8$ aromatics.

We claim as our invention:

1. A process combination for selectively upgrading a naphtha feedstock comprising the steps of:

(a) contacting the feedstock with an aromatization catalyst in an aromatization zone in the presence of hydrogen at aromatization conditions including a pressure of from atmospheric to below 10 atmospheres, a temperature of from 260° to 560° C. and a liquid hourly space velocity of from about 0.5 to 40 $hr^{-1}$ to obtain an aromatization effluent stream;

(b) separating the aromatization effluent stream to obtain a hydrogen-rich gas and an aromatics-rich intermediate stream containing a small proportion of olefins and dissolved hydrogen-containing gas;

(c) contacting the aromatics-rich intermediate stream and a portion of the hydrogen-rich gas to provide a molar ratio of hydrogen to the intermediate stream of from about 0.005 to 0.08 in a selective saturation zone with a saturation catalyst comprising a platinum-group metal component and a refractory inorganic oxide at saturation conditions including a pressure of from about 100 kPa to 10 MPa, a temperature of from about 30° to 300° C. and a liquid hourly space velocity of from about 1 to 50 $hr^{-1}$ to saturate at least about 70% of the contained olefins and less than about 1% of the aromatics and obtain a saturated effluent containing trace residual hydrogen-containing gas; and, (d) stabilizing the saturated effluent in a fractionator to remove trace residual hydrogen-containing gas and to obtain a stabilized aromatics-rich product.

2. The process combination of claim 1 wherein the molar ratio of hydrogen to the intermediate stream of step (c) is from about 0.01 to 0.06.

3. The process combination of claim 1 wherein the aromatics-rich intermediate stream is heated to saturation temperature by heat exchange with the stabilized aromatics-rich product in the absence of an external heat supply.

4. The process combination of claim 1 wherein the contacting in the saturation zone is carried out in mixed vapor-liquid phase.

5. The process combination of claim 1 wherein the platinum-group metal component of step (c) comprises a platinum component.

6. The process combination of claim 5 wherein the saturation catalyst further comprises one or more metals of Group VIB (IUPAC 6) and Group IVA (IUPAC 14).

7. The process combination of claim 1 wherein the refractory inorganic-oxide of step (c) comprises alumina.

8. The process combination of claim 1 further comprising clay treating one or both of the saturated effluent and stabilized aromatics-rich product.

9. A process combination for selectively upgrading a naphtha feedstock comprising the steps of:

(a) contacting the feedstock with an aromatization catalyst in an aromatization zone in the presence of hydrogen at aromatization conditions including a pressure of from atmospheric to below 10 atmospheres, a temperature of from about 260° to 560° C. and a liquid hourly space velocity of from about 0.5 to 40 $hr^{-1}$ to obtain an aromatization effluent stream;

(b) separating the aromatization effluent stream to obtain a hydrogen-rich gas and an aromatics-rich intermediate stream containing a small proportion of olefins and dissolved hydrogen-containing gas;

(c) heating the aromatics-rich intermediate stream and a portion of the hydrogen-rich gas to provide a molar ratio of hydrogen to the intermediate stream of from about 0.01 to 0.06 by heat exchange with a stabilized aromatics-rich product in the absence of an external heat supply to provide a heated saturation feed;

(d) contacting the saturation feed without further heating in a selective saturation zone with a saturation catalyst comprising a platinum-group metal component and a refractory inorganic oxide at saturation conditions including a pressure of from about 100 kPa to 10 MPa, a temperature of from about 30° to 300° C. and a liquid hourly space velocity of from about 1 to 50 $hr^{-1}$ to saturate at least about 70% of the contained olefins and less than about 1% of the aromatics and obtain a saturated effluent containing trace residual hydrogen-containing gas; and, (e) stabilizing the saturated effluent in a fractionator to remove trace residual hydrogen-containing gas and to obtain the stabilized aromatics-rich product.

* * * * *